US005548940A

United States Patent [19]

Baldock

[11] Patent Number: 5,548,940

[45] Date of Patent: Aug. 27, 1996

[54] ROLLED VINYL SIDING

[76] Inventor: Michael J. Baldock, 102 4th St., NE., East Grand Forks, Minn. 56721

[21] Appl. No.: 345,775

[22] Filed: Nov. 22, 1994

[51] Int. Cl.[6] ..... B65B 63/04

[52] U.S. Cl. ..... 53/430; 53/118; 52/518; 242/175; 242/395; 242/613.2

[58] Field of Search ..... 53/430, 445, 118, 53/157; 242/175, 395, 613.2; 52/518, 521

[56] References Cited

U.S. PATENT DOCUMENTS

| | | | |
|---|---|---|---|
| Re. 32,710 | 7/1988 | Seaman | 52/518 |
| 2,847,948 | 8/1958 | Truitt | 52/518 |
| 3,330,499 | 4/1965 | Gooding | 242/613.1 |
| 3,420,365 | 3/1967 | Bailey | 53/430 |
| 3,579,946 | 5/1971 | Graving | 53/430 |
| 4,258,846 | 3/1981 | Campo | 242/175 |
| 4,407,027 | 10/1983 | Colon, Jr. | 242/395 |
| 4,671,036 | 6/1987 | Sullivan | 52/518 |
| 4,829,909 | 5/1989 | Mandel | 108/55.5 |
| 5,037,685 | 8/1991 | Richards et al. | 428/40 |
| 5,198,242 | 3/1993 | Groeblacher et al. | 425/150 |
| 5,232,751 | 8/1993 | Cameron et al. | 428/15 |
| 5,255,726 | 10/1993 | Hasegawa et al. | 144/365 |
| 5,284,693 | 2/1994 | Spain et al. | 428/172 |
| 5,321,921 | 6/1994 | Holt | 52/97 |
| 5,343,664 | 9/1994 | Loucks | 52/518 |

FOREIGN PATENT DOCUMENTS

| | | | |
|---|---|---|---|
| 729932 | 5/1955 | United Kingdom | 53/430 |

*Primary Examiner*—John Sipos
*Assistant Examiner*—Ed Tolan
*Attorney, Agent, or Firm*—Richard C. Litman

[57] ABSTRACT

A method for rolling a rigid vinyl siding elongated sheet of selective dimensions into a convenient transportable compact coil for easier handling and shipping, and products derived from practicing the method. The method includes rolling the sheet onto a spool having a particular axle shape and diameter which varies with the thickness and design of the siding. The shape of the coil may be determined by the shape of the spool axle. For example. the use of a tapered-shaped axle diameter for the spool may produce a substantially conical-shaped coil. Thus, a predetermined length of siding can be rolled with an appropriate spool size to produce a coil product of a desired shape. A method step relates that the granular side of the siding initially contact the surface of the spool and that the smooth side of the siding face outwardly. Fasteners hold the compact coil in a secured manner before the coil is boxed for shipment. In an alternative embodiment, an insert and support spacer sheet made of cardboard or the like is utilized in rolling the siding sheet into a coil.

13 Claims, 4 Drawing Sheets

ROLLED VINYL SIDING

BACKGROUND OF THE INVENTION

1. Field of the Invention

The present invention relates to rolled vinyl siding, and more particularly, to a method for rolling a rigid elongated vinyl siding sheet of selective dimensions into a convenient transportable compact coil for easier handling and shipment and also relates to products derived from practicing the method.

2. Description of the Prior Art

A common procedure of handling and shipping a flexible elongated sheet of construction material such as a sheet of the "tar paper type" construction material is to roll the sheet into a substantially tight coil, and thus an elongated sheet in the form of a coil becomes easily transportable. However, the prior art lacks a solution for handling a rigid elongated vinyl siding sheet which is bulky and difficult to handle because of its length and the inflexibility of the material. For example, in a situation where a consumer purchases a rigid vinyl siding sheet of 240 feet, the consumer finds that the space within a motor vehicle is inadequate to accommodate such a sheet because of its length.

Known prior art patents in the construction art relate to solving problems not specifically related to the instant inventive concept. For example, U.S. Pat. No. 5,037,685 to Richards et al., discloses a flexible elongated vinyl roofing shingle material which is provided in coils for installation on pitched roofs.

A number of other inventions pertaining to vinyl siding and the like have been proposed. Patents illustrating these types of inventions include: U.S. Pat. Nos. Re. 32,710; 5,198,242; 5,232,751; 5,255,726; 5,284,693; 5,321,921; and 5,343,664.

None of the above inventions and patents, taken either singly or in combination, is seen to describe the instant invention as claimed.

SUMMARY OF THE INVENTION

The present invention relates to a method for rolling a rigid elongated vinyl siding sheet of selective dimensions into a convenient transportable compact coil for easier handling and shipping, and to products derived from practicing the method. The method includes rolling the sheet onto a spool having a particular axle shape and diameter which varies with the thickness and design of the siding. The shape of the coil may be determined by the shape of the spool axle. For example, the use of a tapered-shaped spool axle may produce a substantially conical-shaped coil. Thus, a predetermined length of siding can be rolled with an appropriate spool to produce a coil product of the desired shape. A method step provides that the granular side of the siding initially contact the surface of the spool and that the smooth side of the siding face outwardly from the coil. Fasteners hold the compact coil in a secured manner before the coil is boxed for shipment. In an alternative embodiment of the invention, an insert and support spacer sheet made of cardboard and the like is utilized when rolling the siding sheet into a coil.

Accordingly, it is a principal object of the invention to provide a method involving a technician familiar with the art who handles and ships vinyl siding and who can temporarily roll a sheet of rigid elongated vinyl siding of selective dimensions into a convenient transportable compact coil and also to products derived from practicing the method.

It is another object of the invention to provide a method for temporarily rolling in a convenient and expeditious manner a substantially flat rigid vinyl siding sheet of predetermined dimensions onto a spool having a predetermined diameter and producing thereon a transportable compact coil.

It is another object of the invention to provide a method for converting a substantially seamless rigid vinyl siding sheet of selective dimensions into a boxed compact coil which is more acceptable for use by a consumer in the marketplace.

It is another object of the invention to provide a method for converting a rigid vinyl siding sheet of selective dimensions into a compact coil which is easily transported from one place to another.

It is a further object of the invention to provide both method and product for the purposes described which are inexpensive, dependable and fully effective in accomplishing the intended purposes of the invention.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Broadly, the instant invention relates to a method for rolling a rigid elongated vinyl siding sheet or strip of selective dimensions into a convenient transportable compact coil for easier handling and shipping, and also to products derived therefrom. The method includes rolling the sheet onto a spool or mandrel having a selective axle shape and diameter which varies with the thickness and design of the siding. The shape of the coil is determined by the shape of the spool axle. For example, the use of a tapered-shaped axle diameter for the spool produces a substantially conical-shaped coil. Thus, a predetermined length of siding can be rolled with an appropriate spool to produce a coil product of the desired shape. A method step relates that the granular side of the siding initially contact the surface of the spool and that the smooth side of the siding face outwardly. Fasteners hold the compact coil in a secured manner before the coil is boxed for shipment. In an alternative embodiment of the invention, an insert and support spacer sheet made of cardboard and the like is utilized when rolling the siding into a coil.

Figure 1:
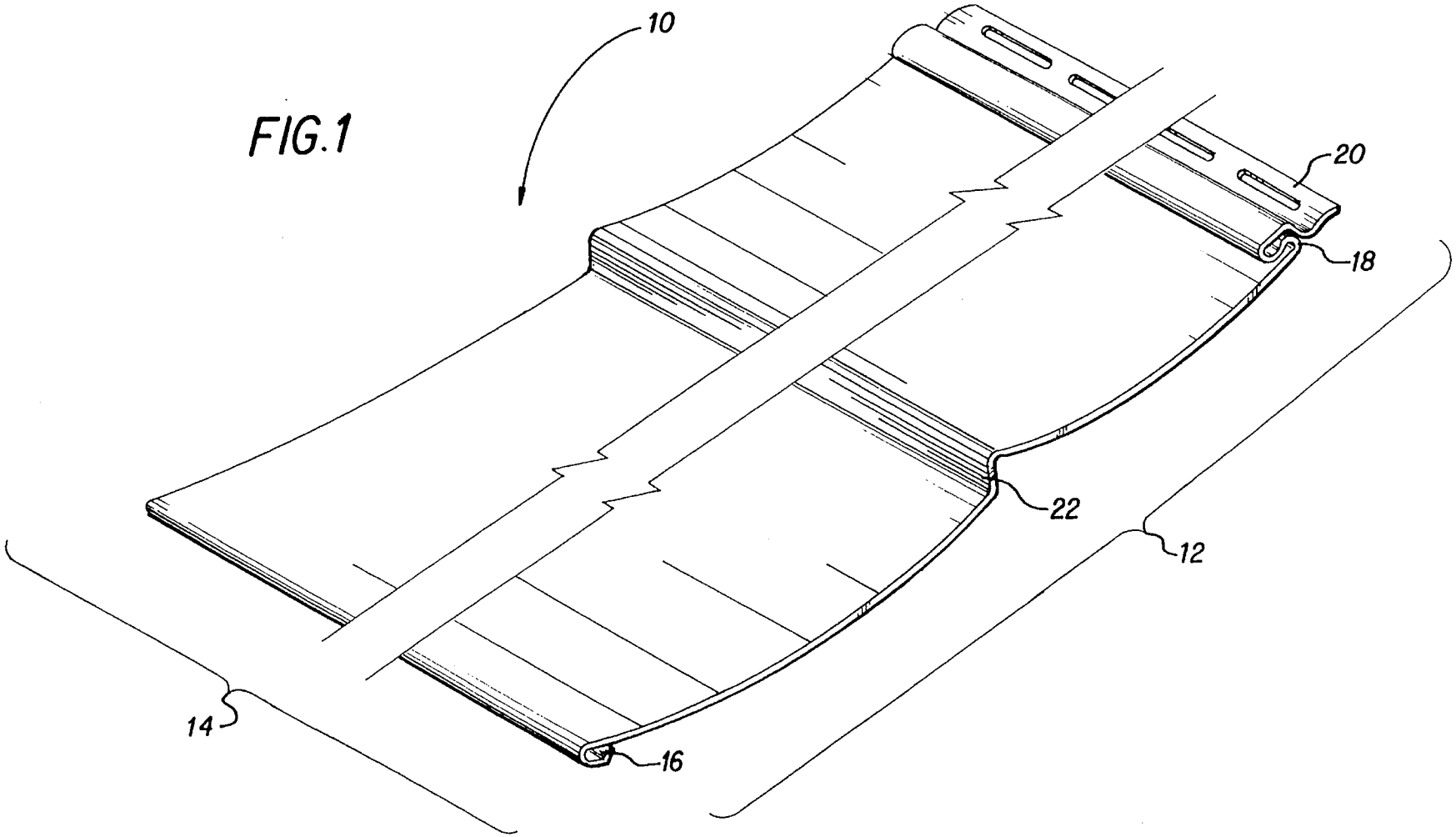
FIG. 1 is a perspective view of a sheet of vinyl siding with its rolled and curved portions.

FIG. 1 shows a sheet 10 of vinyl siding which has a width 12 and a length 14. The sheet 10 is composed of a substantially hard rigid vinyl siding material. It is difficult to roll the sheet 10 widthwise, but it may be rolled lengthwise. The width section is difficult to bend not only because of the hardness of the material, but also because of its small dimension. However, the length section 14 is easier to bend because of it extensive length. An example of dimensions for a sheet of a particular type of vinyl siding to be rolled, is one foot for the width section 12 and two hundred and forty feet for the length section 14. The width 12 includes a rolled edge 16 at one end, a rolled edge 18, a slotted flange 20 at the other end and a median bent section 22. The 240 foot length sheet can readily be rolled without damage despite factors pointing to the contrary. The 240 foot length section 14 could represent an entire length of a sheet for a particular wall section, and since it is preferably a continuous strip it could be seamless. The use of a seamless sheet would have many advantages, such as more attractive appearance and less waste of material.

Figure 2:
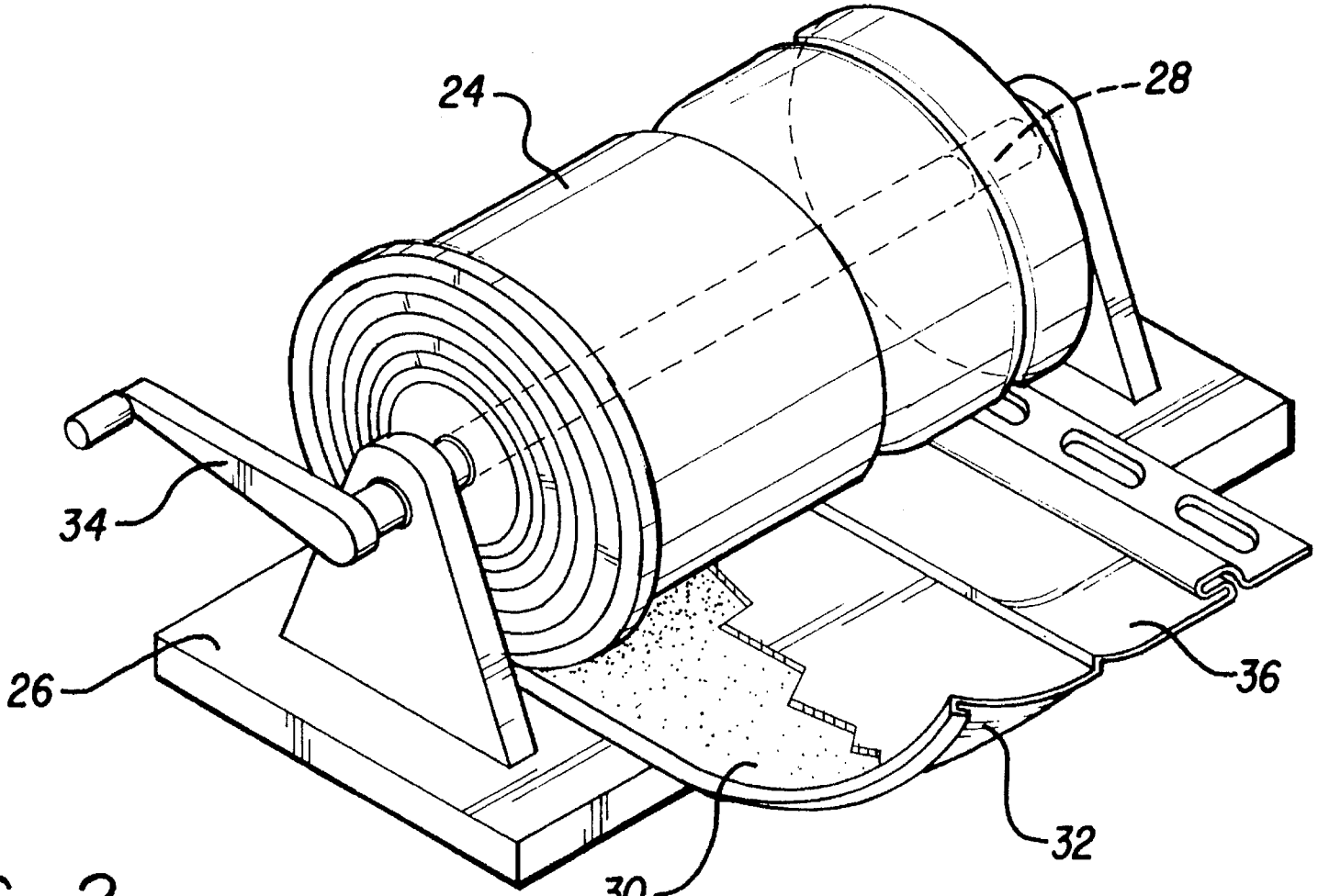
FIG. 2 is a perspective view of the vinyl siding sheet partially rolled in a cylindrical-shaped coil on a spool assembly and a spacer sheet overlying the siding sheet.

FIG. 2 shows the sheet 10 of vinyl siding partially rolled in a cylindrical-shaped coil 24 on a stand assembly 26. To actually roll a rigid siding sheet into a true cylindrical-shaped coil would be difficult because of a number of factors. For example, the rolls 16, 18 and the median bent section 22 of the sheet 10 may limit such a rolling action to achieve a cylindrical shape. However, for the purpose of explaining the invention, a substantially flat siding sheet can be considered capable of being rolled into a cylindrical shape.

Further, FIG. 2 shows the sheet 10 mounted on the stand assembly 26 having a spool 28 (shown in dotted lines). In accordance with the above example, if an entire edge of the one foot width 12 is grasped by a technician who is familiar with the art and rolled continuously for the length 240 feet, the resultant coil 24 would have the cylindrical configuration as illustrated in FIG. 2. To avoid kinking, that is, a short tight twisting or curling caused by a doubling or winding of the sheet 10 upon itself, it has been determined that the coil 24 must have at least a minimum core diameter of two feet. In other words, the spool 28 would have a two foot diameter to achieve the approximately two foot core diameter for the coil 24. As noted previously, the particular size and configuration of the diameter of the coil 24 varies with the thickness and design features of the siding, as well as with the degree of skill of the technician.

Further in FIG. 2, a turned up corner portion of the sheet 10 shows a rough granular side 30 and a smooth side 32. The winding of the coil 24 on the spool 28 represents an efficient and convenient way of coiling the sheet 10 into a compact coil in lieu of coiling by hand. The method requires that the granular side 30 initially contact the surface of the spool 28 at the start of the rolling step and that the smooth side 32 of the siding face outwardly when the sheet 10 is completely coiled into coil 24. A crank handle 34 is shown as the power means for winding the sheet 10, but it is obvious that motor power or the like may be utilized.

Further, as an alternative embodiment of the invention, an insert spacer and support sheet 36 made of cardboard, plastic and the like is illustrated in FIG. 2 as an upper sheet thereof. The spacer sheet 36 overlies the vinyl siding sheet 10. The use of a spacer sheet will enhance the appearance of the commercial coiled product. Further, the spacer and support sheet 36 will add support and protection to the various curves, curved portions and contours of the sheet 10 and therefore, will substantially lessen the possibility of damage occurring during the rolling of the sheet and storage of the coil 24.

Figure 3:
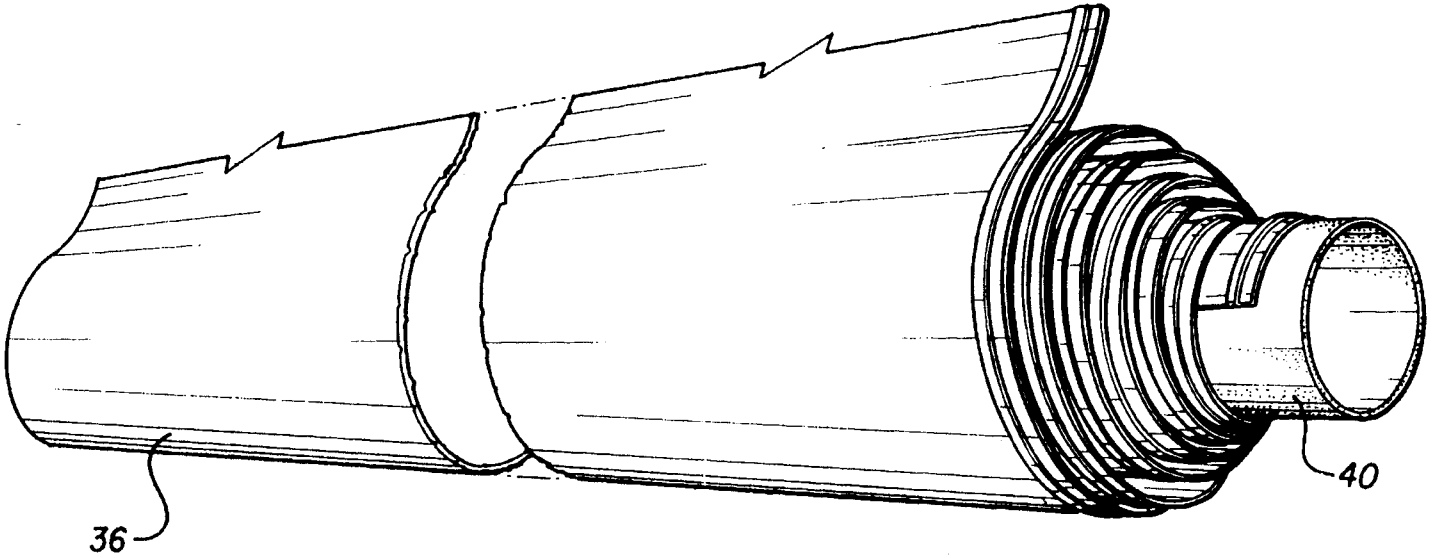
FIG. 3 is a partial perspective view of a sheet of vinyl siding partially rolled in a conical-shaped coil on a tapered spool.

FIG. 3 shows a partially wound conical-shaped coil 38 which has been wound on a tapered-shaped spool 40. The actual resultant coil configuration may not be conical-shaped, but may be somewhat an oval-shaped configuration for reasons stated above. As previously stated with respect to the cylindrical-shaped coil 24, if an edge of the one foot width section is grasped by the technician and then rolled continuously for the length of 240 feet and in this instance rolled onto the tapered axle spool 40, the resultant coil may have a substantially conical or oval configuration. It is readily understood that various combinations of length sizes and diameters for the spool axle may be utilized and that various shaped coils may result in accordance with the teachings of the invention. It is optional whether a spool is included in a completed rolled coil that is to be shipped. A preferred resultant configuration for a commercial product which would be easy to handle and ship may be a substantially oval-shaped coil without the spool because such a coil will have less weight and the like.

Figure 4:
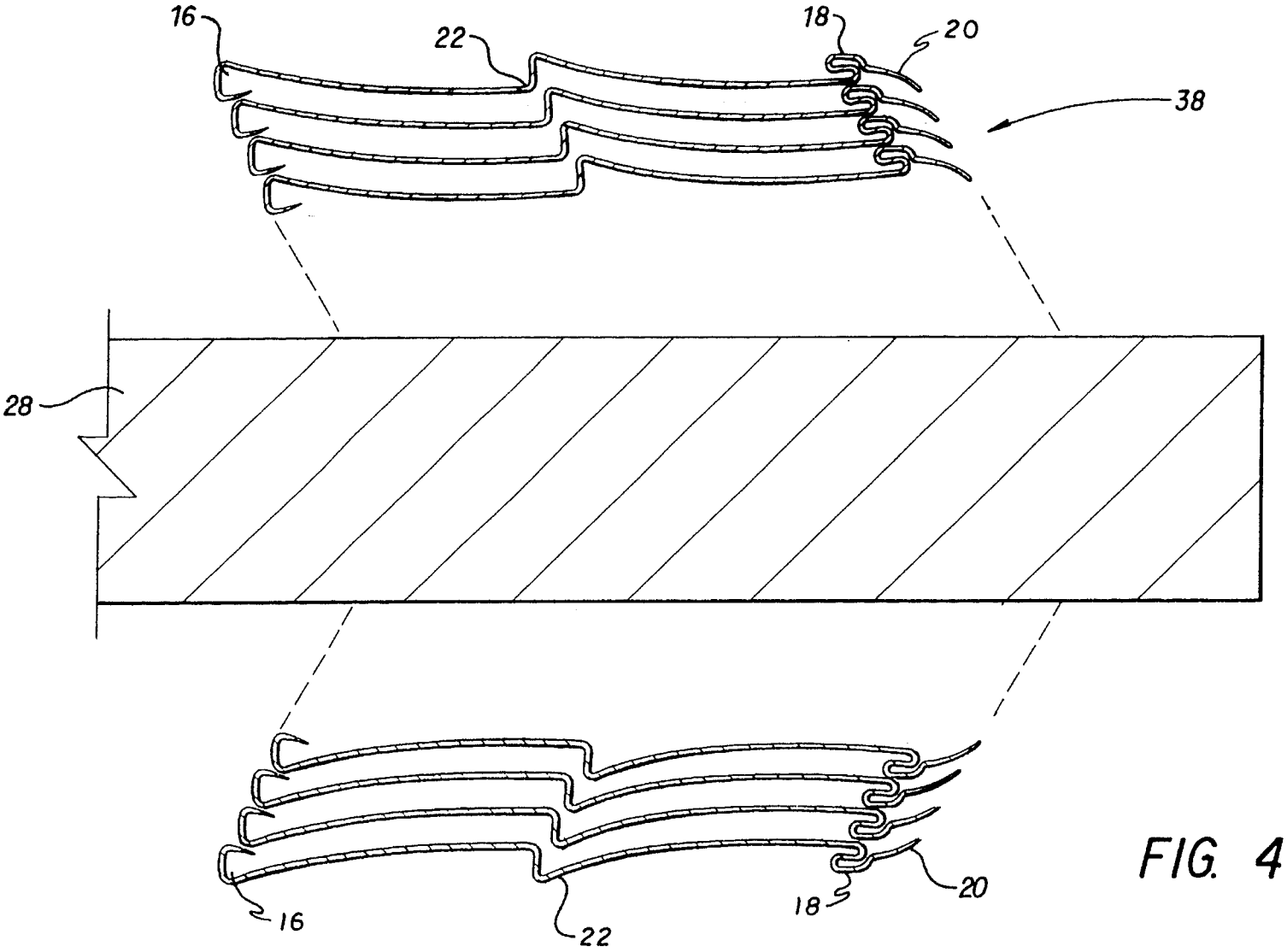
FIG. 4 is a partial cross sectional view taken vertically through FIG. 3, showing a plurality of nesting rolled edges and median bent sections of the sheet.

FIG. 4 is a cross-sectional view of the conical-shaped coil 38. As illustrated, a plurality of rolled edges 16, 18 and the median bent section 22 of the single rolled sheet 10 may nest continuously or periodically with respect to each other and produce a rolled coil where there may be a mixture of nesting and non-nesting sections within the rolled coil. Thus, the configuration for a resultant coil product may be not conical, but oval or the like.

Figure 5:
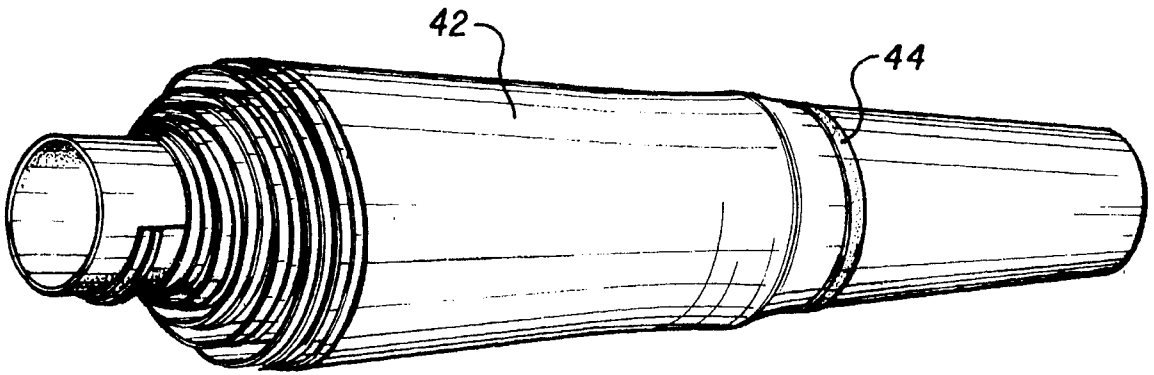
FIG. 5 is a perspective view of a completely rolled, oval-shaped coil with a fastening strap around the rolled coil.

FIG. 5 shows a completely rolled coil 42 having a substantially oval configuration. In addition, FIG. 5 shows a fastening strap 44 wound around the oval-shaped coil 42. The material for the fastening strap 44 may be a hook and loop fastener type, e.g., "Velcro" material or the like.

In summary, the method for temporarily converting a substantially flat rigid vinyl siding sheet of selective dimensions into a compact coil for the purpose of easier handling and shipping of a commercial product involves the following steps:

providing a substantially flat rigid elongated sheet having a smooth side and a granular granular and having a predetermined length (for example, a minimum length for a particular designed vinyl siding is considered to be 240 feet) and width dimensions;

rolling the sheet manually or preferably providing a spool having a predetermined shape and sized diameter (for example, a cylindrical-shaped spool axle having a two-foot core diameter);

taking one end of the elongated sheet and rolling it in such a manner that the granular side of the sheet is initially in contact with the surface of the spool and that the smooth side will face outwardly during the rolling thereof and will be the exposed layer on the finished coiled product;

rolling the entire length of the sheet onto the spool for forming a coil thereon; and fastening the other end of the elongated sheet onto the coil itself whereby an easily transportable compact coil product is provided.

If the spool has a cylindrical axle, the resulting compact coil will have a cylindrical configuration. If the spool has a tapered axle, the resultant compact coil will have a substantially conical configuration.

An optional additional step of the method would be to add a continuous insert and support spacer sheet made of cardboard and the like to the rolled coil so that the resultant coil is composed of a protective spacer sheet adjacent to the vinyl siding sheet.

It is to be understood that the present invention is not limited to the embodiments described above, but encompasses any and all embodiments within the scope of the following claims.

I claim:

1. A method for converting semi-rigid vinyl siding sheet into a compact coil, said method comprising the steps of:

providing a vinyl siding sheet having a length, a width, a smooth side, a granular side, said vinyl sheet having a top rolled edge including a slotted flange, a bottom rolled edge, and a median bent section extending along said length;

providing support to the vinyl siding sheet during rolling by inserting a spacer sheet adjacent the siding sheet;

providing a spool having an axle diameter of at least two feet;

rolling the siding sheet lengthwise with the granular side initially in contact with the spool and having the smooth side of the siding facing outwardly during the rolling thereof;

rolling the entire length of the siding sheet and the spacer sheet onto the spool for forming a compact coil thereon; and packaging the compact coil for easier handling and shipping.

2. The method according to claim 1, wherein the axle of the spool has a predetermined, selective geometrical shape, whereby the resulting rolled compact coil mounted on the axle has substantially the same selective geometrical configuration.

3. The method according to claim 1 wherein the axle of the spool has a tapered-shape, whereby the resulting rolled compact coil mounted on the axle has a substantially conical configuration.

4. The method according to claim 1 wherein the length of the siding sheet is selected to be on the order of at least 240 feet.

5. The method according to claim 1 wherein said spacer sheet is cardboard.

6. The method according to claim 1 wherein said spacer sheet is plastic.

7. The method according to claim 1 further comprising the step of securing the formed coil with a fastener.

8. A combination of an elongated sheet of vinyl siding and a spool, comprising in combination:

a semi-rigid elongated vinyl siding sheet having a smooth side and a granular exterior side and having predetermined length and width dimensions, said vinyl siding sheet having a top rolled edge, a bottom rolled edge, and a median bent section extending along the length;

a spool having a predetermined axle diameter; and means for rolling the elongated sheet lengthwise onto the spool to form a coil having the granular exterior side contacting the spool, the coil thereon of having a predetermined configuration, which configuration depends on the predetermined axle diameter.

9. The combination according to claim 8 wherein the core of the compact coiled sheet has a predetermined inner core diameter selected to be on the order of at least two feet.

10. The combination according to claim 8 wherein the spool has a cylindrical axle, whereby the resulting compact coiled sheet has a cylindrical configuration.

11. The combination according to claim 8 wherein the axle of the spool is tapered, whereby the resultant compact coiled sheet has a conical configuration.

12. The combination according to claim 8 wherein the length of the siding sheet is selected to be on the order of at least 240 feet.

13. The combination according to claim 8 and includes a spacer sheet adjacent the siding sheet for supporting the sheet as it is rolled.

* * * * *